US005086921A

United States Patent [19]

Neff

[11] Patent Number: 5,086,921

[45] Date of Patent: Feb. 11, 1992

[54] STORING ELEMENT FOR RING TRAVELLERS FOR SPINNING OR TWISTING MACHINES

[75] Inventor: Andreas Neff, Pfäffikon, Switzerland

[73] Assignee: Braecker AG, Switzerland

[21] Appl. No.: 449,514

[22] Filed: Dec. 5, 1989

Related U.S. Application Data

[63] Continuation of Ser. No. 267,090, Nov. 4, 1988, abandoned, which is a continuation of Ser. No. 448,704, Dec. 10, 1982, abandoned.

[30] Foreign Application Priority Data

Aug. 5, 1982 [CH] Switzerland ..... 4707/82-4

[51] Int. Cl.[5] ..... B65D 85/24

[52] U.S. Cl. ..... 206/338; 29/450; 206/293; 206/493; 206/822; 221/312 A; 221/312 C

[58] Field of Search ..... 29/765, 450, 789, 797, 29/809; 206/343, 338, 298, 293, 292, 402, 527, 822, 389, 493, 499; 221/312 A, 312 C; 293/128

[56] References Cited

U.S. PATENT DOCUMENTS 3,606,431 9/1971 Kunevicius ..... 293/128
3,606,433 9/1971 Kunevicius ..... 293/128

FOREIGN PATENT DOCUMENTS 1028919 4/1958 Fed. Rep. of Germany .
5138993 12/1980 Japan .
471012 5/1969 Switzerland .

*Primary Examiner*—Irene Cuda
*Attorney, Agent, or Firm*—Michael N. Meller

[57] ABSTRACT

An elongate, flexible storing or magazine element serves to receive at its outside ring travellers to be used in spinning or twisting machines. The storing element comprises a profiled strip composed of a retaining member and a back or spine member. The retaining member is positioned within the internal space of the ring travellers and the leg portions of the ring travellers are clamped at the retaining member. The back member is wider than the retaining member; it is positioned outside the ring travellers and serves as an abutment or stop for the leg portions of the ring travellers. This storing or magazine element permits each ring traveller to be individually retained and independently of the preceding and subsequent state and the number of ring travellers stored on the profiled strip.

8 Claims, 2 Drawing Sheets

FIG. 4A
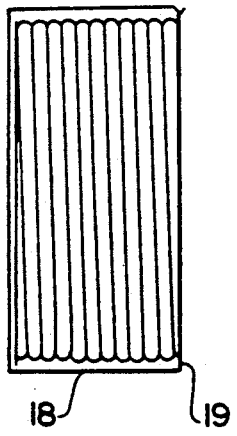
FIG. 4B
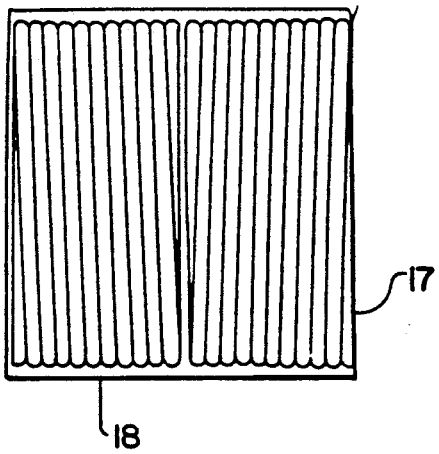
FIG. 6
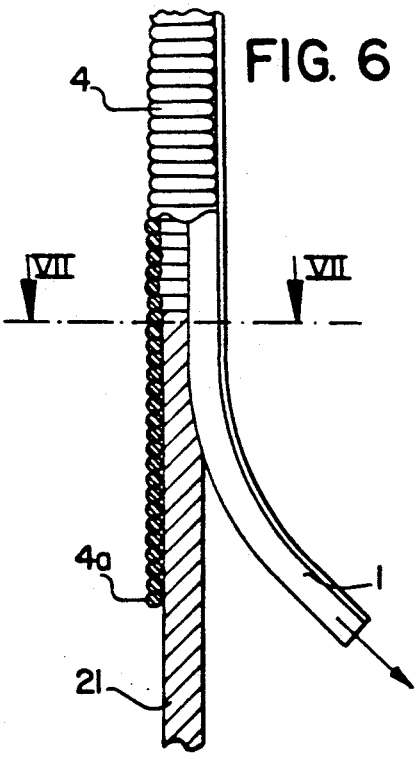
FIG. 5
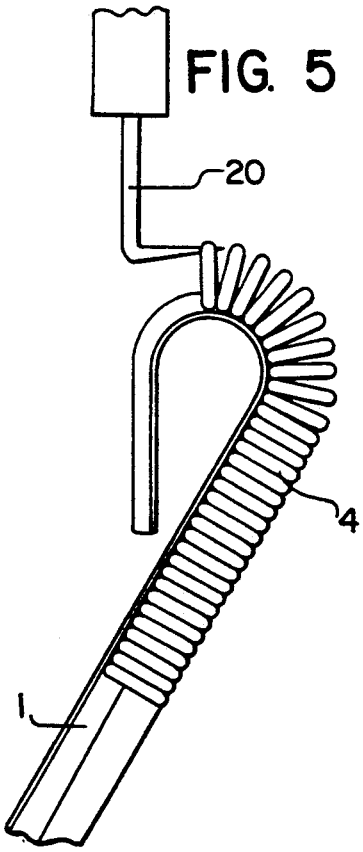
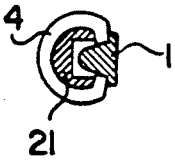
FIG. 7

STORING ELEMENT FOR RING TRAVELLERS FOR SPINNING OR TWISTING MACHINES

CROSS-REFERENCE TO RELATED APPLICATION

The application is a continuation of application Ser. No. 267,090, filed Nov. 4, 1988 now abandoned, which is a continuation of the commonly assigned, copending U.S. patent application Ser. No. 06/448,704, filed Dec. 10, 1982 and entitled: "STORING ELEMENT AND STORING APPARATUS FOR RING TRAVELLERS FOR SPINNING OR TWISTING MACHINES AND METHOD OF PRODUCING AND USING SAID STORING APPARATUS", now abandoned.

BACKGROUND OF THE INVENTION

The present invention relates to a new and improved storing or magazine element and storing apparatus for ring travellers to be used in ring spinning or ring twisting machines, in particular for ring travellers containing an internal space and having two leg portions. The present invention also relates to a new and improved method of producing and using the storing or magazine apparatus containing a series or row of ring travellers for use in ring spinning or ring twisting machines.

A known storing magazine element for ring travellers encloses a series arrangement or row of ring travellers and forms a cover or sheath made of plastics permitting the orderly handling of the ring travellers. The groups of ring travellers arranged in rows by arranging means are then enclosed by the plastic cover. The arranging means is removed after the ring travellers are retained by the cover. This prior art storing element is suitable for charging the storing or magazine bars of an applicator or mounting unit or a machine, that is to say, for the groupwise removal of ring travellers. Therefore, the cover has to be cut and removed in each case. This known storing element is less suited for the individual removal of ring travellers, since the latter when carried out manually only can be accomplished with great difficulty. Also, it is difficult to produce a cut in the cover required for this purpose and which corresponds in length to the width of the ring traveller. In case the cut is too long, however, then a greater number of ring travellers may emerge from the cover than desired.

A further known storing or magazine element comprises a flexible plastic band upon which the ring travellers are loosely arranged or strung and from which they are removed towards one end thereof. This plastic band may be inserted into a removal device instead of a storing bar. To prevent the ring travellers from unintentionally dropping out therefrom, both ends of the plastic band must be blocked. Furthermore, the dimensions of the plastic band must exceed the width of the ring gap, in order to prevent the ring travellers from dropping out through the latter. Despite these measures the handling of the plastic band and, respectively, the removal of the ring travellers is cumbersome when the plastic band has been partially emptied.

SUMMARY OF THE INVENTION

Therefore with the foregoing in mind it is a primary object of the present invention to provide an improved storing or magazine element for ring travellers intended to be used in ring spinning or ring twisting machines in which the individual ring travellers are independently retained.

Another and more specific object of the present invention aims at the provision of a new and improved storing element for ring travellers intended to be used in ring spinning or ring twisting machines in which each individual ring traveller is retained independently of the preceding or succeeding ring travellers of a row thereof.

Another significant object of the present invention is directed to a new and improved construction of storing element for ring travellers intended to be used in ring spinning or ring twisting machines and which is relatively simple in construction and design, quite economical to manufacture, extremely easy to use, and not readily subject to breakdown or malfunction.

A further noteworthy object of the present invention is directed to a new and improved construction of storing apparatus containing a storing element according to the invention for the orderly and positive storing of ring travellers for use in ring spinning or ring twisting machines.

Still a further significant object of the present invention is directed to a novel method of producing the storing apparatus and to the use of the storing apparatus.

Now in order to implement these and still further objects of the invention, which will become more readily apparent as the description proceeds, the elongate, flexible storing or magazine element of the present development, among other things, is manifested by the features that it comprises a profiled strip of flexible material containing a first member and a second member. The first member forms a relatively narrow retaining or holder member intended to be positioned within the internal space of the ring travellers and clamps the two leg portions of the ring travellers. The second member forms a relatively wide back or spine member intended to be positioned outside the ring travellers and engages or abuts against the leg portions of the ring traveller. The storing element receives the ring travellers in an orderly arrangement on the outside or exterior thereof.

By clamping the leg portions of the ring travellers at the retaining or holder member, the design of the profiled strip according to the invention permits the ring travellers to be retained individually and independently of each other. Correspondingly, each ring traveller can be removed individually and independently of the other ring travellers in a direction which is substantially normal or perpendicular to the profiled strip.

Upon charging or loading the profiled strip the first relatively narrow retaining member is positioned in the interior or internal space of the ring traveller which is retained at its opening at this retaining member. The opening of the ring traveller is bounded by the leg portions thereof which exert a clamping action upon the relatively narrow retaining member at that region where they engage the retaining member. Consequently, the leg portions are positively retained at the retaining or holder member.

The back or spine portion forms an abutment or stop for each ring traveller in that such ring traveller only can be pressed onto the profiled strip until the back member is engaged. Characteristically the back or spine member is designed with an increased cross-section in comparison to the retaining or holder member. In a direction extending away from the back member the retaining member also may have an increased, although smaller cross-section or an enlargement. In such case the retaining or clamping region of the profiled strip is formed by two oppositely situated grooves which are followed by different shoulders, namely by the retaining member and by the back member.

The storing element according to the invention may be produced simply and economically by extrusion from a melt, with different sizes and shapes of the ring travellers being accounted for by different shapes of the nozzles or the like of the extruder and different types of ring travellers may be characterized by imparting different colors to the profiled strips.

The inventive storing element may be readily charged or loaded rapidly and free of failure by pressing the ring travellers onto the profiled strip.

The ring travellers may be individually removed from the storing element according to the invention either solely manually or by employing suitable tools. Also, the storing bars of an applicator device may be loaded in one step with the required number of ring travellers from the storing element. Advantageously, however, the storing element loaded with the ring travellers is inserted as such into the applicator device. In the applicator device the ring travellers are moved to a removal location by drawing or pulling the profiled strip and they are removed in a direction which is substantially perpendicular to the profiled strip. Again, the individual retention of the ring travellers and removal of the same transversely with respect to the extension or course of the strip has proven to be of particular advantage. By individually retaining the ring travellers the position thereof upon the profiled strip, and thus, the location of removal are unequivocally defined. By laterally removing the ring travellers at a well-defined location the removal path is identical for all ring travellers independent of their position along the length of the profiled strip, thereby rendering possible troublefree operation of the applicator or mounting device.

Since during loading of the storing element such ring traveller attached thereof is immediately retained and upon removal thereof only the desired number of ring travellers are moved without others becoming loosened, no loss of ring travellers will occur due to only weakly retained or loosened ring travellers.

BRIEF DESCRIPTION OF THE DRAWINGS

The invention will be better understood and objects other than those set forth above, will become apparent when consideration is given to the following detailed description thereof. Such description makes reference to the annexed drawings wherein.

FIG. (*4a–b*) shows in section sleeves for holding spool members with a profiled strip according to the invention wound-up thereupon;

FIG. 5 illustrates the removal of an individual ring traveller from the storing apparatus according to the invention;

FIG. 6 illustrates the transfer of ring travellers from the profiled strip according to the invention to a storing or magazine bar; and FIG. 7 is a section through the arrangement of FIG. 6, taken substantially along the line VII—VII thereof.

DETAILED DESCRIPTION OF THE PREFERRED EMBODIMENTS

Figure 1:
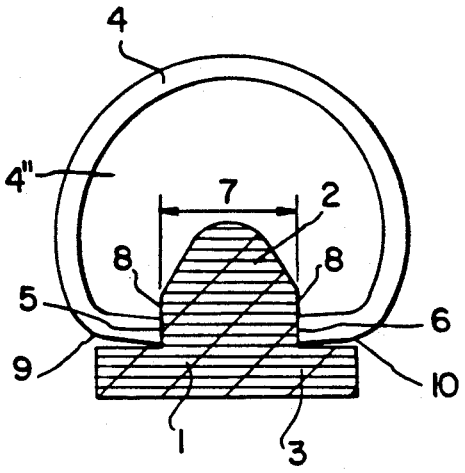
FIG. 1 is a section of a profiled strip according to the invention loaded with a C-shaped ring traveller.

Describing now the drawings, specifically FIG. 1, there has been illustrated in sectional view a profiled strip or elongate member 1 which is designed symmetrically in respect of a plane extending normal thereto. The profiled strip 1 comprises a first member 2, namely a retaining or holder member 2 which is shown positioned within the internal space 4'' of a C-shaped ring traveller 4. The profiled strip 1 also comprises a second member 3, namely a back or spine member 3 which is positioned outside the ring traveller 4. The ring traveller 4 has two leg portions or members 5 and 6 bounding an opening 7 of the ring traveller 4 and which snugly contact the retaining or clamping region 8 of the retaining or holder member 2 at which these leg portions are retained.

Figure 2:
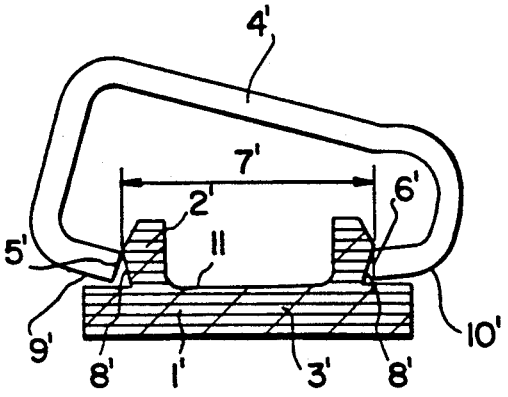
FIG. 2 is a section through a modified embodiment of the profiled strip according to the invention loaded with a J-shaped ring traveller.

At the same time, the exterior or outer faces 9 and 10 of the ring traveller 4 which are contiguous to the opening 7 engage the back or spine member 3 of the profiled strip 1. Following the retaining or clamping region 8 the retaining member 2 is provided with a tapered, rounded cross-section which facilitates the attachment or mounting of the ring traveller 4. The retaining member 2 has a seamless connection with the contiguous back member 3, that is to say, the retaining member 2 merges with the back member 3 without any separating line. The sectional line through the surface of the profiled strip which faces away from the ring traveller 4 is a straight line, that is to say, this surface forms a flat or planar surface in the straightened-out or stretched configuration of the profiled strip A modified embodiment of the inventive storing element is shown in FIG. 2 in a sectional view similar to FIG. 1 and the same or analogous components are generally designated in FIG. 2 by single primed reference numerals. The profiled strip or elongate member 1' of the modified embodiment is shown in section in FIG. 2 and also is designed symmetrically with respect to a plane extending normally or perpendicular thereto. A first member 2' thereof, which is positioned within a J-shaped ring traveller 4', has a groove 11. Both the leg portions or members 5' and 6' bounding the opening 7' of the ring traveller 4' only partially contact the retaining or clamping region 8'.

Figure 3:
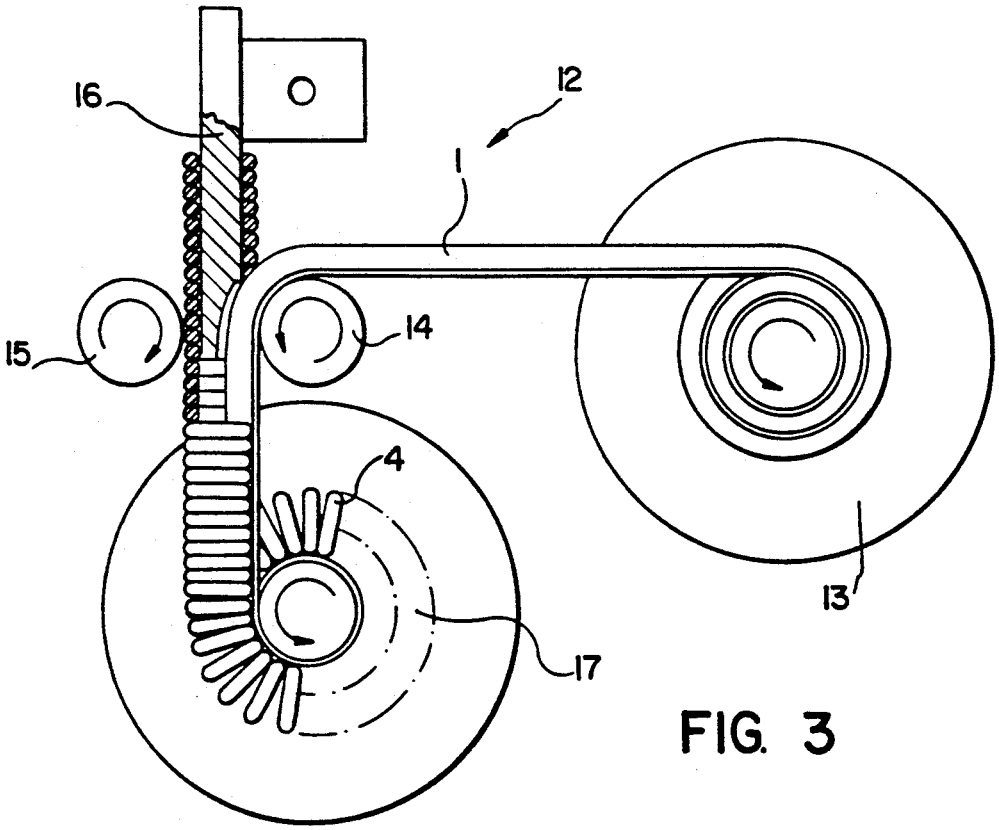
FIG. 3 is an illustration of an apparatus for loading or charging the profiled strips according to the invention with ring travellers.

In FIG. 3 there is schematically shown an apparatus 12 for loading or charging the profiled strip 1 with ring travellers 4. The apparatus 12 comprises a supply or delivery roll 13 for the profiled strip 1 and two pairwise arranged rollers 14 and 15. One of the rollers, here the roller 14, forms a pressing roller for pressing the retaining member 2 of the profiled strip 1 into the opening 7 of the ring traveller 4, while the other roller 15 serves as a support or back-up roll. A delivery or supply mandrel 16 or equivalent structure is provided for the ring travellers 4 which are shown partially in section and in a stacked or series or row-like arrangement. A wind-up spool 17 is provided for the profiled strip 1 which has been loaded with the ring travellers 4.

The apparatus shown in FIG. 3 also may be supplied directly with ring travellers from stringing means or the like for arranging the ring travellers in rows.

During operation of the apparatus shown in FIG. 3 the profiled strip 1 is withdrawn from the supply or delivery roller 13 by means of the rollers 14 and 15 which are driven by conventional means. The retaining or holder member 2 of the profiled strip 1 is pressed into the opening 7 of each ring traveller 4 located in a stacked configuration upon the delivery or supply mandrel 16 by means of the rollers 14 and 15. The ring travellers 4 located on the supply or delivery mandrel 16 may be advanced either by gravity or by any suitable feed or advancing means (not shown). The loaded profiled strip 1 is then wound-up upon a wind-up spool 17 which rests on a suitable driven holder means (not shown); the loaded profiled strip 1 then may be cut to any desired length.

For the mounting or attachment of the ring travellers 4 at the profiled strip 1 the retaining or holder member 2 is urged or pressed into the opening 7 of each ring traveller 4. Therefore, there is advantageously utilized the elasticity or resiliency of the plastics material forming the profiled strip 1, on the one hand, and the elasticity or resiliency of the plastics material forming the ring travellers 4, particularly with respect to widening its opening 7, on the other hand. When the retaining or holder member 2 of the profiled strip 1 is pressed into the ring opening 7, this operation is stopped by the larger diameter or dimension of the back or spine member 3 located contiguous to the retaining member 2. After attachment, the ring traveller 4 is retained in the retaining or clamping region 8 of the profiled strip 1 at its opening 7. In addition to the retaining or clamping region 8, also the back member 3 of the profiled strip 1 and possibly those portions of the retaining member 2 which are located outside the retaining region 8 and have a larger diameter than such retaining region 8 contribute to the fixed retention of the ring travellers 4.

As shown in side view in FIG. 4, the spool or spool member 17 provided with the loaded profiled strip is provided with a sleeve 18 and is ready to be delivered for use. At one of its ends the sleeve or sleeve member 18 is provided with means 19 enabling interconnection of a number of sleeves to form a greater unit.

Removal of individual ring travellers 4 from the profiled strip 1 may be accomplished in accordance with FIG. 5, for instance by using a conventional ring traveller hook 20 or the like. By bending the profiled strip 1 the ring travellers 4 are spread apart so as to ensure that each ring traveller 4 can be individually gripped. By means of the same hook 20 the removed ring traveller 4 then may be applied to the spinning or twisting ring of the ring spinning or ring twisting machine.

As shown in FIG. 6, partially in section, the ring travellers 4 also may be transferred directly to the storing bar 21 or the like of a spinning or twisting machine or an applicator or mounting means. Therefore, the foremost ring traveller 4*a* is pushed onto the storing bar 21 and the profiled strip or elongate member 1 is withdrawn in the direction of the indicated arrow. By removing the profiled strip 1 in this way the transfer of the ring travellers 4 to the storing bar 21 and the advancement of the ring travellers 4 along the storing bar 21 are simultaneously effected.

FIG. 7 is a section taken along the line VII—VII of FIG. 6 and shows a ring traveller 4 already engaged by the storing bar 21 while simultaneously still being held by the profiled strip 1.

It will be understood that there are possible other modifications of the storing element according to the invention other than those illustrated by way of example in the drawings. Thus, for example, the storing element or at least the back or spine member thereof may be designed asymmetrically, in order to facilitate the wind-up operation or to achieve a stable wound-up state or package. Also, the retaining member of the profiled strip may have a cross-section having four, five or a multiple number of corners or may be of circular segment-like shape. The surface or face of the back member of the profiled strip which is remote from the ring traveller also may form a curved plane.

The spools for the profiled strip loaded with the ring travellers preferably have dimensions enabling the spool or spool member to be placed into the pocket of work clothes of the user. However, the spool also may be worn around the neck or attached to the clothing of the user by means of a loop or the like.

The ring travellers not only may be removed from the profiled strip in the manner shown in FIGS. 5 and 6, but also manually, something which is facilitated by spreading apart the ring travellers as shown in FIG. 5.

The profiled strip is made of any suitable plastics material which must be flexible and must have a certain elasticity or resiliency to enable the wind-up operation upon the spool, on the one hand, and, on the other hand, to enable the ring travellers to be pressed thereon, to be retained thereon and to be removed therefrom. Also, the plastics material should have sufficiently high mechanical strength for performing the loading and discharging or removal operations. Within this framework governed by the mentioned properties any plastics material may be utilized.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A ring traveller supply device comprising an elongate flexible storing element in combination with a plurality of aligned ring travellers intended to be used in ring spinning or ring twisting machines carried thereon, said elongate flexible storing element comprising a self-supporting elongate profiled strip of flexible material said profiled strip having a first portion integrally interconnected with a second portion;

said first portion defining retaining means having a maximum width which is only slightly greater than the width of an opening in each of said ring travellers;

said retaining means being positioned within an internal space of the ring travelers and serving for clamping leg portions of said ring travellers at said region of engagement of said retaining means and thus independently supporting each one of a series of said ring travellers on said elongate profiled strip; and said second portion defining a back member positioned externally of said ring travellers and arranged to contactingly engage the leg portions of said ring travellers, said back member having a width substantially greater than said maximum width.

2. The storing element as defined in claim 1, wherein: said retaining means has a width which is decreasing in a direction extending towards said back member.

3. The storing element as defined in claim 1, wherein:

said retaining means possesses a polygonal cross-sectional configuration.

4. The storing element as defined in claim 1, wherein:

said profiled strip is made of a plastics material.

5. The storing element as defined in claim 1, wherein:

said elongate profiled strip of flexible material possesses a predetermined length; and said first portion and said second portion continuously extending over said predetermined length of said elongate profiled strip of flexible material.

6. The storing element as defined in claim 1, wherein:

said retaining means has a width in the vicinity of said region of engagement of said retaining means with a first ring traveller which is decreasing in a direction extending away from said back member; and said retaining means is a rounded surface.

7. The storing element as defined in claim 1, wherein:

said retaining means clamps said leg portions of said ring travellers for removal of said ring travellers from said profiled strip in a direction which is substantially normal to the lengthwise direction of said profiled strip.

8. The storing element as defined in claim 1, wherein:

said retaining means has a width which is decreasing in a direction extending away from said back member.

* * * * *